US006847281B2

(12) United States Patent
Kolarsky

(10) Patent No.: US 6,847,281 B2
(45) Date of Patent: Jan. 25, 2005

(54) ELECTRICAL COIL, IN PARTICULAR FOR SOLENOID VALVES

(75) Inventor: Jens Kolarsky, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 32 days.

(21) Appl. No.: 10/239,641

(22) PCT Filed: Dec. 6, 2000

(86) PCT No.: PCT/DE00/04343

§ 371 (c)(1),
(2), (4) Date: Feb. 6, 2003

(87) PCT Pub. No.: WO01/73799

PCT Pub. Date: Oct. 4, 2001

(65) Prior Publication Data

US 2003/0151481 A1 Aug. 14, 2003

(30) Foreign Application Priority Data

Mar. 24, 2000 (DE) ..... 100 14 738

(51) Int. Cl.[7] ..... H01F 27/02
(52) U.S. Cl. ..... 336/90; 336/208; 336/198
(58) Field of Search ..... 336/192, 198, 336/208, 180, 185

(56) References Cited

U.S. PATENT DOCUMENTS

| | | | | |
|---|---|---|---|---|
| 4,151,500 A | * | 4/1979 | Malerba et al. | 336/185 |
| 4,157,517 A | * | 6/1979 | Kneisel et al. | 333/205 |
| 4,166,265 A | * | 8/1979 | Reynolds et al. | 336/192 |
| 4,183,002 A | * | 1/1980 | Haslau | 336/192 |
| 4,721,935 A | | 1/1988 | Gunnels et al. | |
| 5,225,801 A | | 7/1993 | Yashuhiko et al. | |

FOREIGN PATENT DOCUMENTS

| | | |
|---|---|---|
| EP | 0 002 099 A | 5/1979 |
| WO | WO 97 02581 A | 1/1997 |

* cited by examiner

*Primary Examiner*—Anh Mai
(74) *Attorney, Agent, or Firm*—Ronald E. Greigg

(57) ABSTRACT

An electrical coil has a coil body, at least one face-end flange of the coil body, at least one mount for coil wire on the face-end flange, and one tonguelike insulation displacement contact for contacting the coil wire in the mount. Two intersecting slots of different depth are embodied on the mount, and the coil wire rests on the bottom of the slot of lesser depth, while the tonguelike insulation displacement contact is received in the slot of greater depth. Since the slot of lesser depth, in the region of its bottom, has a width which is less than the diameter of the coil wire, the coil wire is firmly clamped in the mount. The electrical coil is particularly useful for use in magnet valves.

1 Claim, 1 Drawing Sheet

ELECTRICAL COIL, IN PARTICULAR FOR SOLENOID VALVES

CROSS-REFERENCE TO RELATED APPLICATIONS

This application is a 35 USC 371 application of PCT/DE 00/04343, Filed on Dec. 6, 2000.

BACKGROUND OF THE INVENTION

1. Field of the Invention

The invention is directed to an electrical coil and more particularly to an improved electrical coil for magnet valves.

2. Description of the Prior Art

One known electrical coil is already known (French Patent Disclosure FR 2 517 105), in which the coil wire is placed on the mount, inserted from the insulation displacement contact into the slot of lesser depth, and is contacted by removal of the insulating wire sheathing. A disadvantage in this known embodiment is the lack of a firm hold on the coil wire before the insulation displacement contact is created. This can lead to misconnections.

SUMMARY OF THE INVENTION

The electrical coil of the invention has the advantage over the prior art that the coil wire can be secured in the slot of lesser depth by clamping, before the insulation displacement contact is made. In this way, the beginning of the coil wire, and after the electrical winding is completed, the end of the coil wire can both be fixed on the coil body. In this way, the beginning and end of the coil wire continue to be secured in their position until the insulation displacement contact has been created. Misconnections are is thus avoided.

By means of the step on the mount, a support surface for the coil wire, on which the coil wire can be sheared off, is created in a simple way.

BRIEF DESCRIPTION OF THE DRAWINGS

One exemplary embodiment of the invention is explained in further detail herein below with reference to the drawings, in which.

DESCRIPTION OF THE PREFERRED EMBODIMENT

Figure 1:
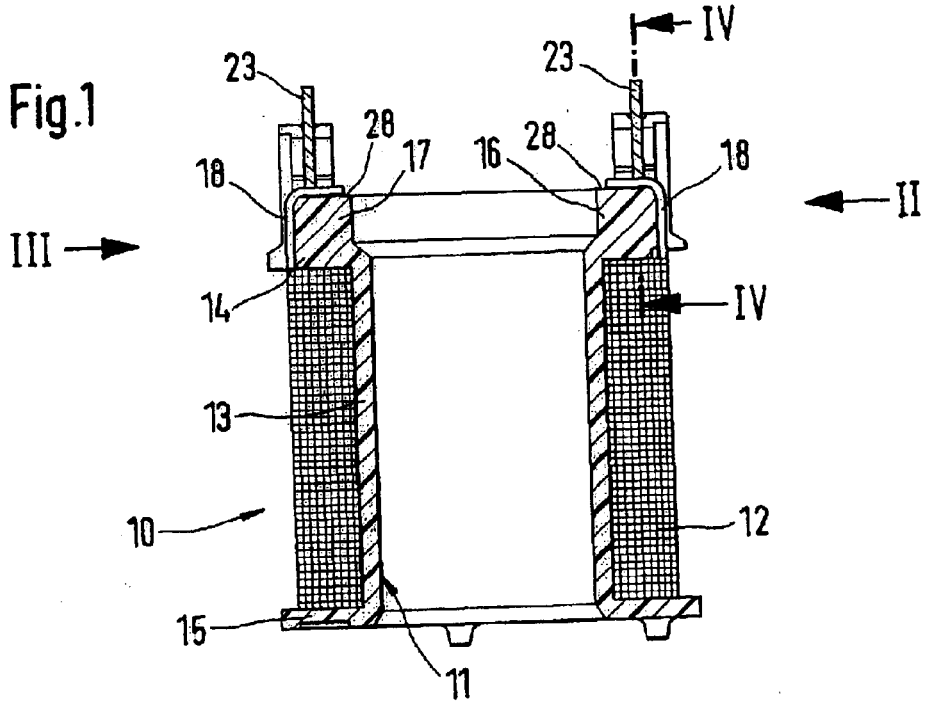
FIG. 1 is a longitudinal section through an electrical coil with coil wires clamped at their ends on mounts of the coil body.

An electrical coil, marked 10, for a magnet valve, not shown, has a coil body 11 and an electric winding 12 (FIG. 1). The coil body 11, made in the form of a plastic injection-molded part, is constructed of a sleeve 13 and two flanges 14 and 15 joined at their face ends to the sleeve. Two mounts 16 and 17 for coil wire 18 that are disposed diametrically relative to the longitudinal axis of the coil body are formed onto the flange 14, on the side remote from the sleeve.

Figure 2:
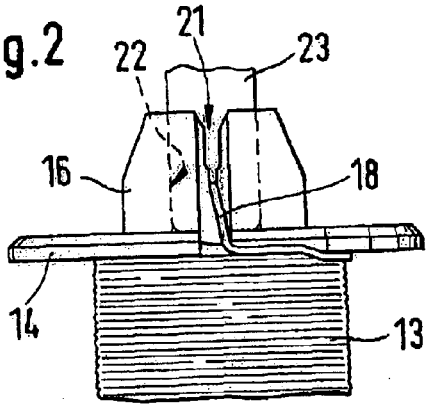
FIG. 2 is a view in the direction of the arrow II in FIG. 1 of a mount with the beginning of the coil wire.
Figure 3:
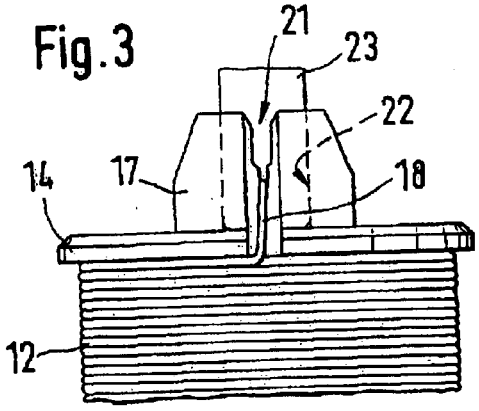
FIG. 3 is a view in the direction of the arrow III in FIG. 1 of amount with the end of the coil wire.
Figure 4:
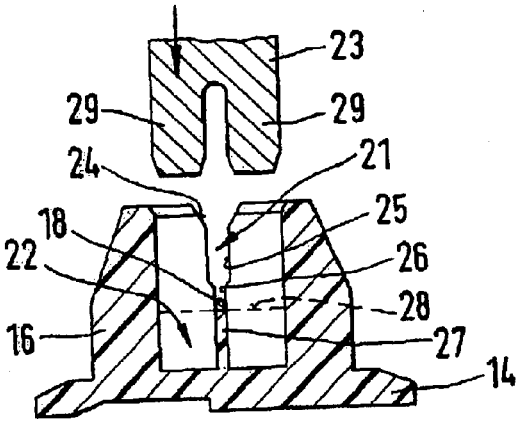
FIG. 4 is a section taken along the line IV—IV in FIG. 1 through a mount with a clamped coil wire, before an insulation displacement contact is created, on a larger scale.

Each of the two mounts 16 and 17, which protrude in peglike form up from the flange 14, are provided with two intersecting slots 21 and 22 of different depth (FIGS. 2–4).

A slot 21 of less depth extends radially, relative to the longitudinal axis of the coil body, in an axial plane. The slot 21 penetrates the respective mount 16 or 17 through its full width. A slot 22 of greater depth intersects the slot 21 at a right angle and extends parallel to the longitudinal axis of the coil body. The slot 22 is adapted to the dimensions of a tonguelike insulation displacement contact 23 for contacting the coil wire 18 in the respective mount 16 and 17.

The slot 21 of lesser depth begins with a wedge-shaped widened portion 24 (FIG. 4) at the face end, remote from the flange, of the respective mount 16 and 17. This enlarged portion is adjoined by a portion 25 of the slot 21 that has a greater width than the diameter of the coil wire 18. Adjoining this, the slot 21 changes over, in the region of its bottom, into a portion 26 that has a width which is less than the diameter of the coil wire 18. At the bottom of the slot 21, the portion 26 ends at a rib, known as an anvil 27, which, intersecting the slot 22 of greater depth, extends in the longitudinal direction of that slot. Finally, the two mounts 16 and 17 are provided, radially inward, with an exposed step 28, which extends in the plane of the bottom formed by the slot 21 of lesser depth.

For fabricating the electrical winding 12 of the coil 10, the beginning of the coil wire 18 is introduced into the slot 21 of lesser depth in the mount 16 and is clamped in the portion 26 (FIG. 2). Next, the winding 12 is created. The end of the coil wire 18 is thereupon secured in the slot 21 of the mount 17, in the same way as for the mount 16 (FIG. 3). The excess residual length of the beginning and end of the coil wire is cut off with a cutting tool, not shown, in which process the step 28 of the two mounts 16 and 17 serves as a support surface for the coil wire 18. After that, for contacting the coil wire 18, the tonguelike insulation displacement contacts 23 are introduced into the slots 22 of greater depth in the two mounts 16 and 17 (FIG. 4). In the process, two legs 29 embodied on the insulation displacement contact 23 shear off the insulation from the coil wire 18 resting on the anvil 27 and contact the electrical conductor of the coil wire.

The foregoing relates to preferred exemplary embodiments of the invention, it being understood that other variants and embodiments thereof are possible within the spirit and scope of the invention, the latter being defined by the appended claims.

I claim:

1. An electrical coil (10) for magnet valves, the coil comprising a coil body (11), at least one face-end flange (14) of the coil body (11), at least one mount (16, 17) for coil wire (18) on the face-end flange (14), one tonguelike insulation displacement contact (23) for contacting the coil wire (18) in the at least one mount (16, 17), the at least one mount (16, 17) having two intersecting slots (21, 22) of different depth, the coil wire (18) resting on the bottom of the slot (21) having the lesser depth and the tonguelike insulation displacement contact (23) being received in the slot (22) of greater depth, the slot (21) of lesser depth having a width, in the region of its bottom, that is less than the diameter of the coil wire (18), and the mount (16, 17) having an exposed step (28), extending in the plane of the bottom of the slot, on which step the coil wire (18) is braced while excess residual length is being cut off.

* * * * *